US007819473B2

(12) United States Patent
Fukai

(10) Patent No.: US 7,819,473 B2
(45) Date of Patent: Oct. 26, 2010

(54) CHAIR

(75) Inventor: Zenroh Fukai, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 12/461,192

(22) Filed: Aug. 4, 2009

(65) Prior Publication Data

US 2009/0289482 A1 Nov. 26, 2009

Related U.S. Application Data

(62) Division of application No. 11/657,525, filed on Jan. 25, 2007, now abandoned.

(30) Foreign Application Priority Data

Jun. 29, 2006 (JP) ..... 2006-178869

(51) Int. Cl.
*A47C 1/024* (2006.01)

(52) U.S. Cl. ..... 297/301.3; 297/292; 297/293; 297/301.4; 297/301.6; 297/301.7

(58) Field of Classification Search ..... 297/292, 297/293, 301.3, 301.4, 301.6, 301.7
See application file for complete search history.

(56) References Cited

U.S. PATENT DOCUMENTS

| | | | |
|---|---|---|---|
| 429,533 | A | 6/1890 | Kerstetter |
| 524,753 | A | 8/1894 | Boyd |
| 1,825,581 | A | 9/1931 | Comerford |
| 2,063,780 | A | 12/1936 | Ball |
| 2,365,200 | A | 12/1944 | Lorenz |
| 2,560,181 | A | 7/1951 | Morvice |
| 4,157,203 | A | 6/1979 | Ambasz |
| 4,183,581 | A | 1/1980 | Karrip et al. |
| 4,711,491 | A | 12/1987 | Ginat |
| 6,276,755 | B1 | 8/2001 | Su |
| 6,588,843 | B1 | 7/2003 | Ebenstein |
| 6,607,244 | B2 | 8/2003 | Stulik et al. |

(Continued)

FOREIGN PATENT DOCUMENTS

| | | | |
|---|---|---|---|
| BE | 381 555 | A | 8/1931 |

(Continued)

OTHER PUBLICATIONS

Wilkhahn website online "Modus: Function"on the Internet <http://www.wilkhahn.co.jp/products/working/modus/function.html>(searched Jun. 15, 2006).

*Primary Examiner*—Laurie K Cranmer
(74) *Attorney, Agent, or Firm*—Rabin & Berdo, PC

(57) ABSTRACT

A chair is provided that is designed so that the angle of the seat surface portion and the angle of the back surface portion are independent of each other and change, and a user can always take the optimum seated posture. The chair includes a base portion, a first link fixed to a seat and rotatably connected to the base portion, and a second link fixed to a seat back rest and rotatably connected to the first link. The chair also includes a first torque-generating mechanism that generates torque in accordance with the angle of the first link relative to the base portion; and a second torque-generating mechanism that generates torque in accordance with the angle of the second link relative to the first link.

3 Claims, 7 Drawing Sheets

U.S. PATENT DOCUMENTS

2002/0000745 A1 1/2002 Conte

FOREIGN PATENT DOCUMENTS

| | | | |
|---|---|---|---|
| DE | 22 41 209 | A1 | 3/1973 |
| EP | 0 164 267 | A | 12/1985 |
| EP | 1 559 348 | A | 8/2005 |
| FR | 756 260 | A | 12/1933 |
| JP | 62-258610 | | 11/1987 |
| JP | 4-48855 | | 4/1992 |
| JP | 2000-505677 | | 2/2005 |
| NL | 7 804 978 | A | 11/1978 |
| WO | WO 93/18686 | A | 9/1993 |

CHAIR

This is a Divisional of U.S. application Ser. No. 11/657,525, filed Jan. 25, 2007, now abandoned the subject matter of which is incorporated herein by reference.

BACKGROUND OF THE INVENTION

1. Field of the Invention

The present invention relates to a chair.

2. Description of the Related Art

Conventionally, chairs have been proposed for use in offices and the like where when the seated user rests against the back surface portion (i.e., the backrest), the seat portion, which is linked to the seat surface portion, moves. Examples of publications that disclose some conventional technologies include the following.

(1) Official Gazette of Japanese Patent Publication No. 2000-505677

(2) Wilkhahn website online "Modus: Function" on the Internet <http://www.wilkhahn.co.jp/products/working/modus/function.html> (searched Jun. 15, 2006)

FIG. 2 is a drawing showing the configuration of a conventional chair.

In FIG. 2, the 113 is a base portion in a conventional chair and is provided with braces and casters (not shown). It is mounted on a floor surface and is designed to support the weight of the entire chair and that of the user seated in the chair. A seat 114 on which the user takes a seat is rotatably attached to the upper end of the base portion 113 via a joint. A first link 112 that supports a seat back rest 115 is rotatably attached via a joint midway to the base portion 113. Further, the seat surface portion 114 and the first link 112 are linked by a second link 111 rotatably attached to both via joints.

For this reason, when a user seated in the chair leans back against the back surface portion 115, the first link 112 that supports the back surface portion 115 rotates relative to the base portion 113 at the joint axis. Also, the seat surface portion 114 is linked to the first link 112 due to the second link 111 so it moves in conjunction with the first link 112 and rotates relative to the base portion 113 on the axis of the joint.

Nonetheless, with this conventional chair, the seat surface portion 114 does not move as long as force is not applied to the back surface portion 115. Accordingly, the user cannot always take the optimum seated posture.

That is, the chair is such that if the back of the user seated on the seat surface portion 114 is not made to incline more than the angle of inclination relative to the seat surface portion 114 of the back surface portion 115 in the beginning state, the seat surface portion 114 does not move. For this reason, in a case such as when the user seated on the seat surface portion 114 is performing work while facing a desk, if the user is not leaning back against the back surface portion 115, the angle of the seat surface portion 114 does not change. Accordingly, the user is not always able to take the optimum seated posture.

SUMMARY OF THE INVENTION

The present invention seeks to solve the problematic points of conventional chairs, and provides a chair that is designed so that the angle of the seat surface portion and the angle of the back surface portion change independently of each other. With this chair, a user can always take the optimum seated posture.

For the purpose, the chair of the present invention includes: a base portion; a first link fixed to a seat and rotatably connected to the base portion; and a second link fixed to a seat back rest and rotatably connected to the first link. The chair of the present invention includes a first torque-generating mechanism that generates torque in accordance with the angle of the first link relative to the base portion; and a second torque-generating mechanism that generates torque in accordance with the angle of the second link relative to the first link.

Another chair of the present invention further includes: an added torque-generating mechanism that simultaneously generates torque that acts on a joint that connects the base portion and the first link and torque that acts on a joint that connects the first link and the second link in accordance with the angle of the first link relative to the base portion and the angle of the second link relative to the first link.

In yet another chair according to the present invention, the chair includes: a base portion; a first link fixed to a seat; a second link fixed to a seat back rest and rotatably connected to the first link; and a third link whose one end is rotatably connected to the base portion and whose other end is rotatably connected to the first link. The present chair also includes a first torque-generating mechanism that generates torque in accordance with the angle of the first link relative to the third link; a second torque-generating mechanism that generates torque in accordance with the angle of the second link relative to the first link; and a third torque-generating mechanism that generates torque in accordance with the angle of the third link relative to the base portion.

In yet another chair according to the present invention, the chair further includes: a first added torque-generating mechanism that simultaneously generates torque that acts on a joint that connects the third link and the first link and torque that acts on a joint that connects the first link and the second link in accordance with an angle of the first link relative to the third link and an angle of the second link relative to the first link; and a second added torque-generating mechanism that simultaneously generates torque that acts on a joint that connects the base portion and the third link and torque that acts on a joint that connects the first link and the third link in accordance with an angle of the third link relative to the base portion and an angle of the third link relative to the first link.

In yet another chair according to the present invention, the chair includes: a base portion; a first link fixed to a seat; a second link fixed to a seat back rest and rotatably connected to the first link; a third link whose one end is rotatably connected to the base portion and whose other end is rotatably connected to the first link; and a fourth link fixed to the back surface portion and rotatably connected to the second link. The present chair includes: a first torque-generating mechanism that generates torque in accordance with the angle of the first link relative to the third link; a second torque-generating mechanism that generates torque in accordance with the angle of the second link relative to the first link; a third torque-generating mechanism that generates torque in accordance with the angle of the third link relative to the base portion; and a fourth torque-generating mechanism that generates torque in accordance with the angle of the fourth link relative to the second link.

In yet another chair according to the present invention, the chair further includes: a first added torque-generating mechanism that simultaneously generates torque that acts on a joint that connects the third link and the first link and torque that acts on a joint that connects the first link and the second link in accordance with an angle of the first link relative to the third link and an angle of the second link relative to the first link; a second added torque-generating mechanism that simultaneously generates torque that acts on a joint that connects the base portion and the third link and torque that acts on a joint that connects the first link and the third link in accordance with an angle of the third link relative to the base portion and an angle of the third link relative to the first link; and a third added torque-generating mechanism that simultaneously generates torque that acts on a joint that connects the second link and the fourth link and torque that acts on a joint that connects the first link and the second link in accordance with an angle of the fourth link relative to the second link and an angle of the second link relative to the first link.

In yet another chair according to the present invention, the chair includes: a base portion; multiple links that are mutually and rotatably connected, one of which is rotatably connected to the base portion, one of which is fixed to the seat surface portion, and another one of which is fixed to the back surface portion; and a torque-generating mechanism that generates torque in accordance with an angle of the base portion or a link and a link adjoining thereto.

In yet another chair according to the present invention, the chair further includes: an added torque-generating mechanism that simultaneously generates torque that acts on a joint on both sides of the link in accordance with an angle of the link or a base portion adjoining the link.

In yet another chair according to the present invention, the chair includes: a base portion; and multiple links that are mutually and rotatably connected, one of which is rotatably connected to the base portion, one of which is fixed to the seat surface portion, and another one of which is fixed to the back surface portion. The angle of the seat surface portion and the angle of the back surface portion are independent of each other and changeable.

In yet another chair according to the present invention, the chair includes a seat and a seat back rest. The back surface portion changes to a preset position and angle due to a user taking a seat on the seat surface portion.

In yet another chair according to the present invention, the chair includes a seat and a seat back rest. The seat surface portion and the back surface portion each respectively change to a preset position and angle in accordance with the position relation of the head and lower back of a user taking a seat on the seat surface portion.

In yet another chair according to the present invention, the chair includes: a seat, a seat back rest and a pillow. The seat surface portion, the back surface portion and the pillow each respectively changes to a preset position and angle in accordance with the position relation of the head and lower back of a user taking a seat on the seat surface portion.

In yet another chair according to the present invention, the chair includes a seat and a seat back rest. The seat surface portion and the back surface portion each respectively changes to a preset position and angle in accordance with a preset operation.

Due to the present invention, the chair is configured so that the angle of the seat surface portion and the angle of the back surface portion change independently of each other. Due to this, a user can always take the optimum seated posture.

BRIEF DESCRIPTION OF THE DRAWINGS

Preferred exemplary embodiments of the present invention will be described in detail based on the following figures, wherein.

DETAILED DESCRIPTION OF THE INVENTION

Figure 1:
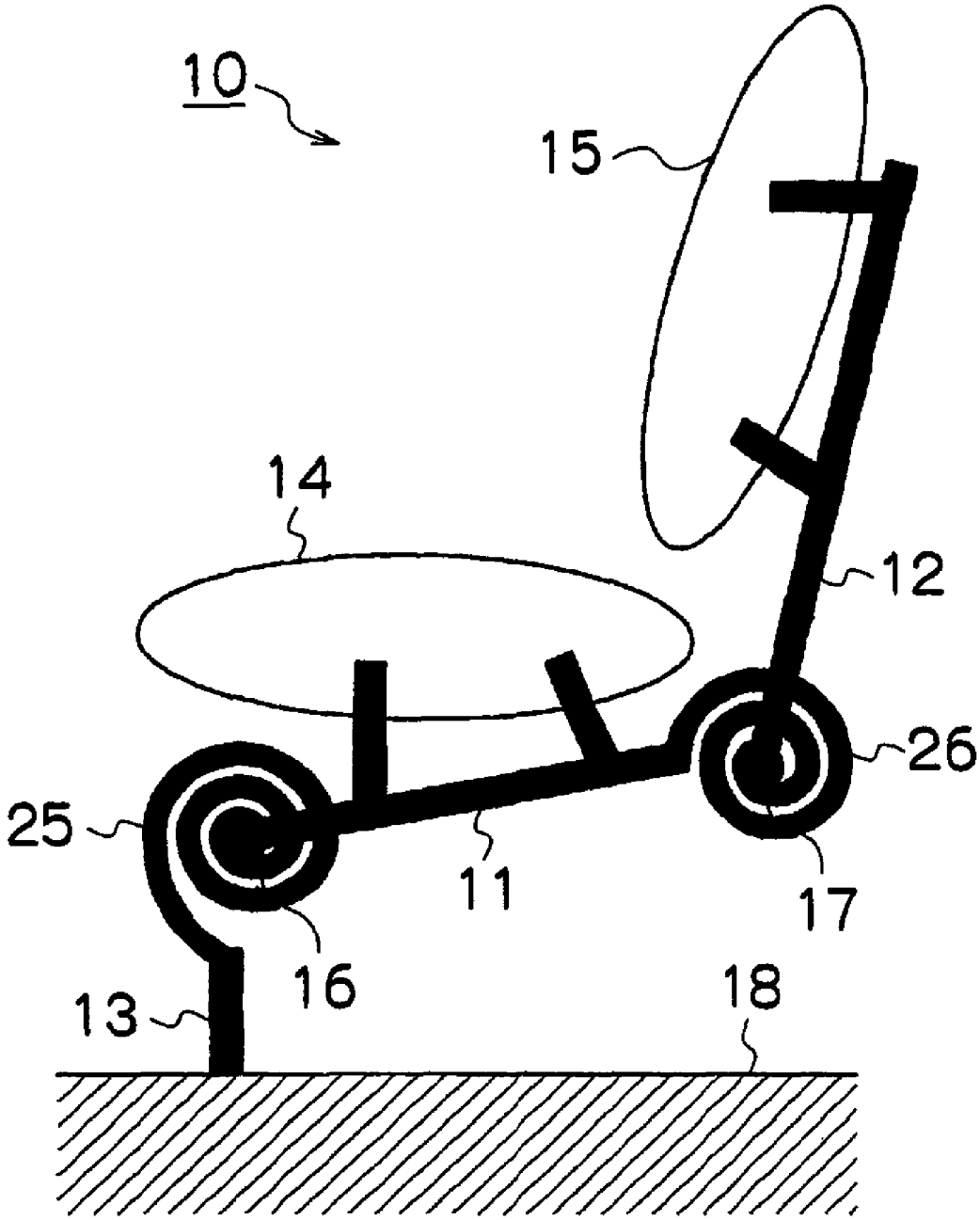
FIG. 1 is a drawing showing the configuration of the chair according to a first embodiment of the present invention.
Figure 2:
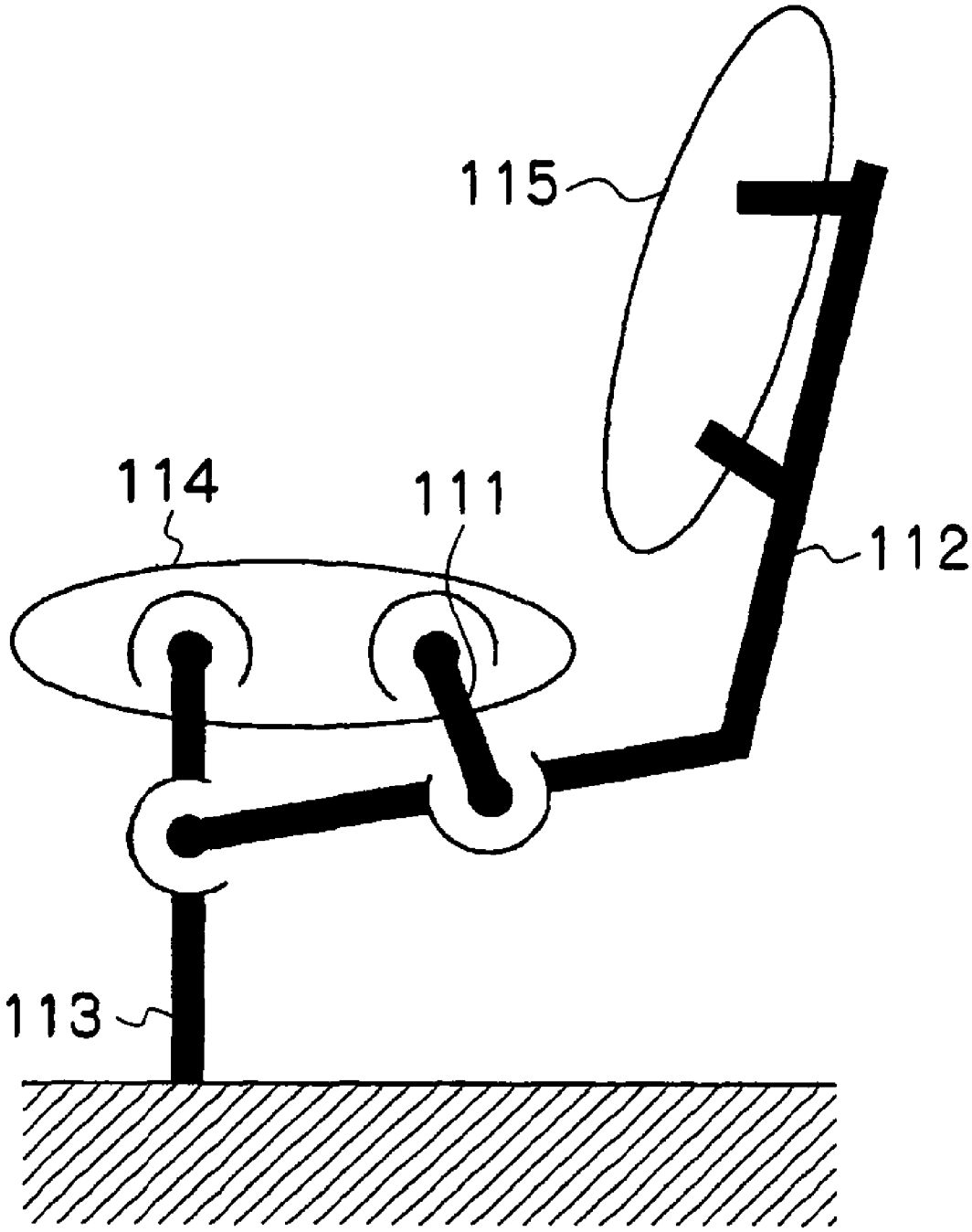
FIG.2 PRIOR ART
FIG. 2 is a drawing showing the configuration of a conventional chair.

Hereafter, exemplary embodiments of the present invention will be described in detail while referring to the drawings.

First Embodiments

FIG. 1 is a drawing showing the configuration of the chair according to a first embodiment of the present invention.

In FIG. 1, the chair in the present embodiment is 10 and is used, for example, in an office and the like for performing office work. The chair can also be used for performing housework in a household, or can be applied to any number of uses in various places. Also, 13 is the base portion of the chair 10 and is provided with components such as a brace and casters and the like (not shown). The base portion 13 is mounted on a floor 18, and is made so as to support the entire chair 10 and the weight of the user taking a seat in the chair 10. Note that the base portion 13 can be movable on the floor 18, such as a part like a caster, or made to be immovable. The base portion 13 can always be maintained at a preset angle relative to the surface of the floor 18, such as at 90°.

Also, a first link 11 is rotatably attached to the base portion 13 via a first joint 16. Here, the first link 11 and the base portion 13 are rotatable around the center of an axis that is vertical relative to the drawing. More specifically, the base portion 13 is provided with an axle bearing at its upper end and the axle bearing is arranged so as to align with a rotational axis that is perpendicular relative to the drawing. Then the first link 11 is provided with an axis at its lower end and the first joint 16 is formed due to insertion of this axis into the axle bearing of the base portion 13. Due to this, the first link 11 becomes rotatable relative to the base portion 13.

Also, a second link 12 is rotatably attached to the first link 11 via a second joint 17. Here, the first link 11 and the second link 12 are rotatable around the center of an axis that is vertical relative to the drawing. More specifically, the first link 11 is provided with an axle bearing at its upper end and the axle bearing is arranged so as to align with a rotational axis that is perpendicular relative to the drawing. Then the second link 12 is provided with an axis at its lower end and the second joint 17 is formed due to insertion of this axis into the axle bearing of the first link 11. Due to this, the second link 12 becomes rotatable relative to the first link 11.

Further, a first torsion spring 25 and a second torsion spring 26 are arranged at the first joint 16 and the second joint 17 as torque-generating mechanisms. Due to this, the directions of rotation with the rotational axes of the first joint 16 and the second joint 17 conform, and a strength of torque is generated in accordance with the angles of rotation.

Specifically, the ends of the first torsion spring 25 are fixed to the base portion 13 and the first link 11, and the ends of the second torsion spring 26 are fixed to the first link 11 and the second link 12. For this reason, when the first link 11 rotates relative to the base portion 13, torque that is in accordance with the angle of rotation generated by the first torsion spring 25 acts upon the rotational axis. Similarly, when the second link 12 rotates relative to the first link 11, torque that is in accordance with the angle of rotation generated by the second torsion spring 26 acts upon the rotational axis.

A seat 14 provided with a cushion and the like on which the user sits is fixed to the first link 11. Also, a seat back rest 15 provided with a cushion and the like upon which the user rests their back is fixed to the second link 12.

Note that the initial angle between the base portion 13 and the first link 11 and the initial angle between the first link 11 and second link 12, in a state where the user has not taken a seat, can be appropriately set. Further, the number of first torsion springs 25 and second torsion springs 26 can also be appropriately set.

Next, the action of the chair with the above-described configuration will be explained.

First, when the user sits on the seat surface portion 14, the first link 11 rotates relative to the base portion 13 due to the reception of the user's weight, and the angle between the base portion 13 and the first link 11 changes. Then the first torsion spring 25 generates torque in accordance with the amount of angle change, that is, the angle of rotation of the first joint 16. Rotation of the first link 11 relative to the base portion 13 stops at a position where the torque generated by the first torsion spring 25 and the burden torque generated by the weight and posture of the user (i.e., the positioning relation between the head and lower back) have balanced out, and the angle between the base portion 13 and the first link 11 settles and becomes fixed.

Similarly, when the user rests against the back surface portion 15, the second link 12 rotates relative to the first link 11 and the angle between the first link 11 and the second link 12 changes. Then the second torsion spring 26 generates torque in accordance with this amount of change in angle, that is, the angle of rotation of the second joint 17. Rotation of the second link 12 relative to the first link 11 stops at a position where the torque generated by the second torsion spring 26 and the burden torque generated by the weight and posture of the user resting against the back surface portion 15 (i.e., the positioning relation between the head and lower back) have balanced out, and the angle between the first link 11 and the second link 12 settles and becomes fixed.

In this manner, with the present embodiment, the angle of the seat surface portion 14 and the angle of the back surface portion 15 change independently of each other. For this reason, the present embodiment differs from a conventional chair where the seat surface portion 114 does not move as long as force is not being applied to the back surface portion 115 as explained in the section regarding related art. With the present chair, the user can always achieve the optimum sitting posture.

Second Embodiment

Next, the second embodiment of the present invention will be explained. Note that with regard to components that have the same structure as in the first embodiment, explanations thereon will be omitted and the same symbol numbers will be applied. Further, explanations on actions and effects that are the same as in the first embodiment will also be omitted.

Figure 3:
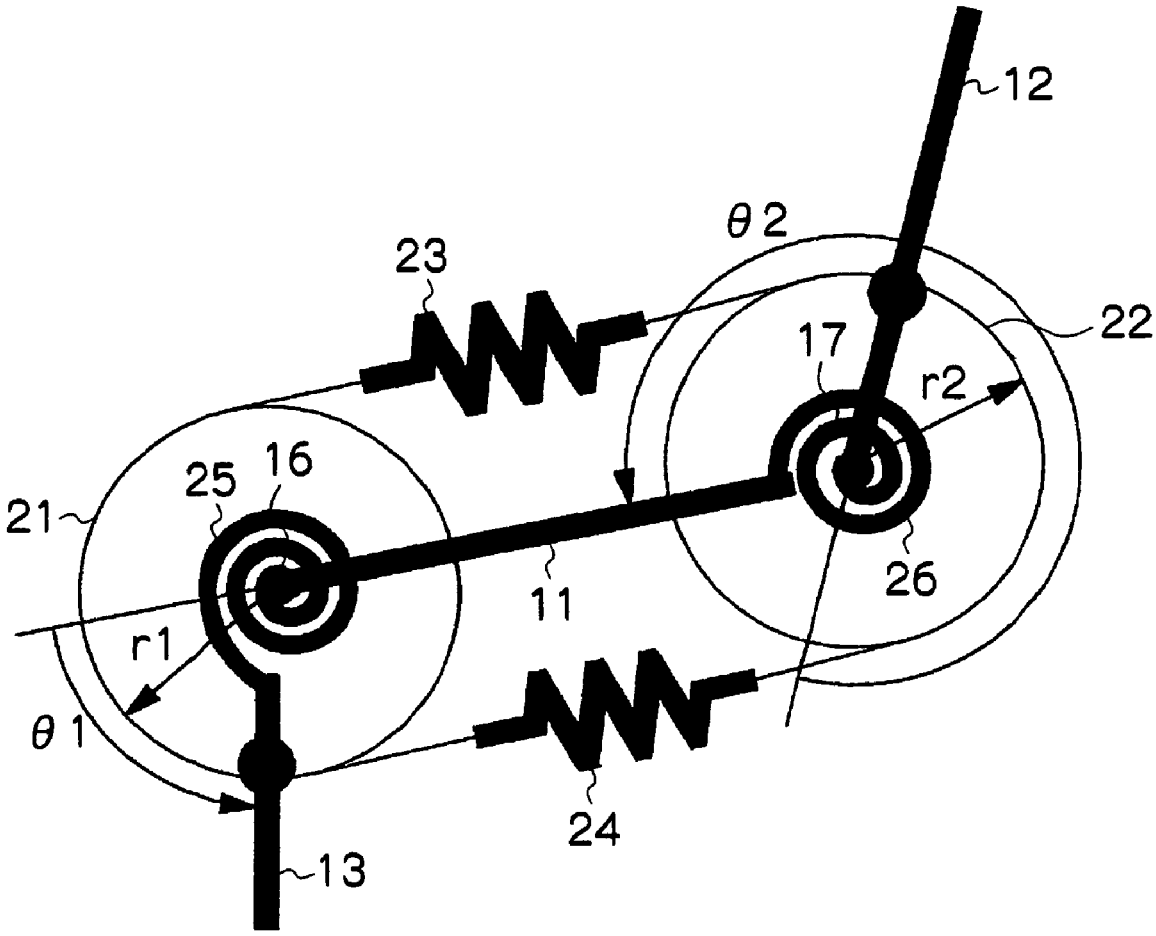
FIG. 3 is a drawing showing the configuration between the first joint and the second joint of the chair according to the second embodiment of the present invention.

FIG. 3 is a drawing showing the configuration between the first joint portion and the second joint portion of the chair according to the second embodiment of the present invention.

Figure 4:
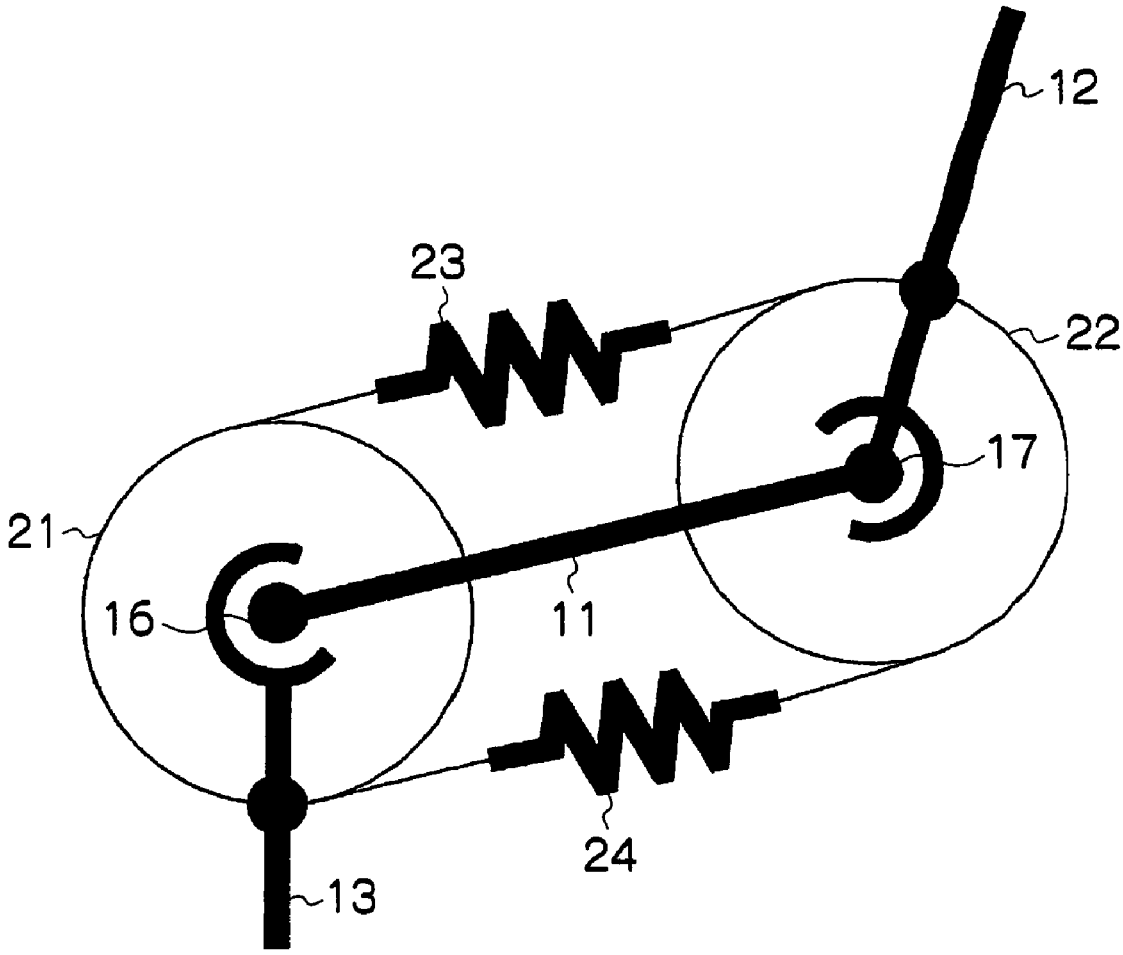
FIG. 4 is a drawing showing the configuration of an added torque-generating mechanism of the chair according to the second embodiment of the present invention.

FIG. 4 is a drawing that shows the configuration of an added torque-generating mechanism of the chair according to the second embodiment of the present invention.

As is shown in FIG. 3, the chair 10 in the present embodiment includes an added torque-generating mechanism added to the first torsion spring 25 and the second torsion spring 26. This mechanism is arranged between the first joint 16 and the second joint 17, and it makes torque act simultaneously on the first joint 16 and second joint 17 in accordance with the angles of rotation of the first joint 16 and second joint 17. The added torque-generating mechanism is provided with a first pulley 21, a second pulley 22, a first tension coil spring 23, and a second tension coil spring 24. Note that the configuration of the added torque-generating mechanism is clearly illustrated in FIG. 4.

Here, the rotational axis of the first pulley 21 is fixed to the base portion 13 so as to be in accordance with the rotational axis of the first joint 16. Similarly, the rotational axis of the second pulley 22 is fixed to the second link 12 so as to be in accordance with the rotational axis of the second joint 17.

Also, wires are fixed at both ends of the first tension coil spring 23. The wire of the lower end side is wound around the outer periphery of the first pulley 21 and fixed thereto. Further, the wire of the upper end side is wound around the outer periphery of the second pulley 22 and fixed thereto.

Similarly, wires are fixed at both ends of the second tension coil spring 24. The wire of the lower end side is wound around the outer periphery of the first pulley 21 and fixed thereto. Further, the wire of the upper end side is wound around the outer periphery of the second pulley 22 and fixed thereto.

Note that with regard to configurations of other points, these are the same as in the first embodiment so explanations thereon will be omitted.

Next, the action of the chair 10 according to the present embodiment will be explained.

First, the constant of springs for both the first tension coil spring 23 and the second tension coil spring 24 is $\kappa$. As shown in FIG. 3, the momentum arms of the first pulley 21 and second pulley 22 are each respectively $r1$ and $r2$. Further, the constant of springs for the first torsion spring 25 and the second torsion spring 26 are each respectively $\kappa 1$ and $\kappa 2$. Furthermore, as shown in FIG. 3, the joint angles of the first joint 16 and second joint 17 at which the first tension coil spring 23 and second tension coil spring 24 are at their natural lengths are each respectively $\theta 1$ and $\theta 2$, and the angles of displacement from the joint angles are each respectively $\delta 1$ and $\delta 2$.

Due to this, a torque $\tau 1$ and $\tau 2$ that are generated by the added torque-generating mechanism and which act upon the rotational axes of the first joint 16 and second joint 17 are shown with the following Formula 1.

$$\begin{pmatrix} \tau 1 \\ \tau 2 \end{pmatrix} = -\begin{pmatrix} \kappa r1^2 + \kappa 1 & \kappa r1 r2 \\ \kappa r1 r2 & \kappa r2^2 + \kappa 2 \end{pmatrix} \begin{pmatrix} \delta 1 \\ \delta 2 \end{pmatrix} \qquad \text{Formula 1}$$

Rotation of the first joint 16 and second joint 17 stops at the position where the torque $\tau 1$ and $\tau 2$ that act upon the rotational axes of the first joint 16 and second joint 17 and the burden torque generated by the weight and posture of the seated user have balanced out, and the angle between the first link 11 and second link 12 is determined. In other words, the seated posture settles and becomes fixed.

In this manner, in the present embodiment, the angle of the base portion 13 and the first link 11 (i.e., the angle of displacement δ1 from the joint angle θ1 of the first joint 16), and the angle of the first link 11 and the second link 12 (i.e., the angle of displacement δ2 from the joint angle θ2 of the second joint 17 move in conjunction, whereby the seated posture is determined.

That is, the chair 10 of the present embodiment differs from a conventional chair where the seat surface portion 114 does not move as long as force is not being applied to the back surface portion 115, as was explained in the section regarding related art. The seat surface portion 14 and back surface portion 15 are linked and move so by appropriately setting each of the parameters, the position of the back surface portion 15 can be set to its optimum position simply by the user taking a seat on the seat surface portion 14.

Furthermore, if a means for imparting a torque ra1 and a torque ra2 to each of the first joint 16 and second joint 17 is added, the torques τ1 and τ2 that act upon the rotational axes of the first joint 16 and second joint 17 are represented by the following Formula 2.

$$\begin{pmatrix} \tau 1 \\ \tau 2 \end{pmatrix} = \begin{pmatrix} \tau a1 \\ \tau a2 \end{pmatrix} - \begin{pmatrix} \kappa r1^2 + \kappa 1 & \kappa r1 r2 \\ \kappa r1 r2 & \kappa r2^2 + \kappa 2 \end{pmatrix} \begin{pmatrix} \delta 1 \\ \delta 2 \end{pmatrix} \quad \text{Formula 2}$$

Due to this, it becomes possible to actively change the posture of the chair 10 so that, for example, when the seated user stands up, movements that assist in that standing up motion become possible.

Third Embodiment

Next, the third embodiment of the present invention will be explained. Note that with regard to components that have the same structure as in the first and second embodiments, explanations thereon will be omitted and the same symbol numbers will be applied. Further, explanations on actions and effects that are the same as in the first and second embodiments will also be omitted.

Figure 5:
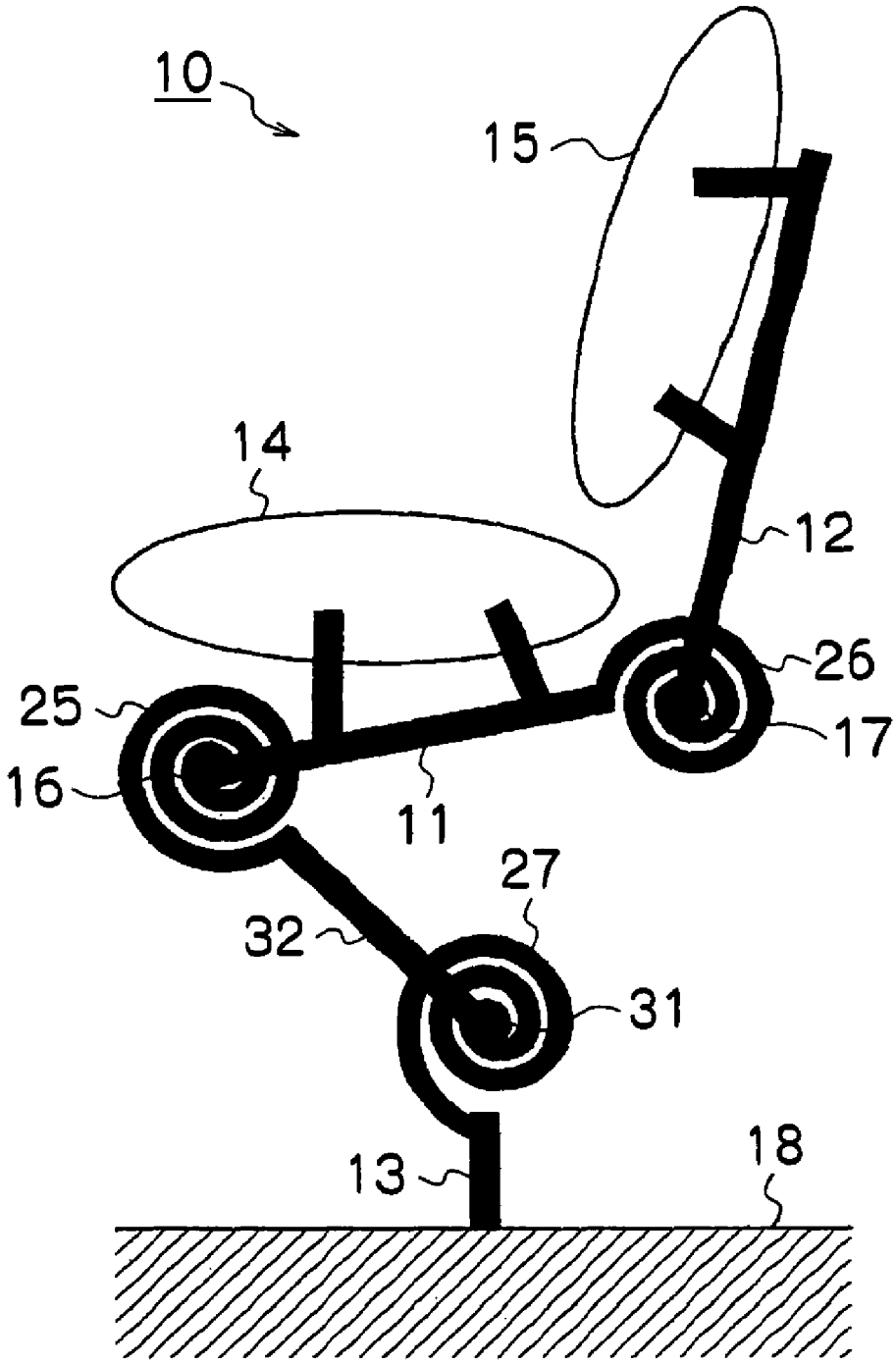
FIG. 5 is a drawing showing the configuration of the chair according to the third embodiment of the present invention.

FIG. 5 is a drawing showing the configuration of the chair according to the third embodiment of the present invention.

As shown in the drawing, the chair 10 according to the present embodiment includes a third link 32 that connects the first link 11 and the base portion 13. In this case, the third link 32 is rotatably attached to the base portion 13 via a third joint 31. A third torsion spring 27 acting as a torque-generating mechanism is arranged at the third joint 31. Note that the third joint 31 and the third torsion spring 27 and the third torsion spring 27 are provided with the same configurations as the first joint 16 and the second joint 17, as well as the first torsion spring 25 and the second torsion spring 26.

Further, the upper end of the third link 32 is rotatably attached to the first link 11 via the first joint 16. The first torsion spring 25 is arranged at the first joint 16.

Furthermore, an added torque-generating mechanism such as shown in FIGS. 3 and 4 is arranged between the first joint 16 and the third joint 31. Note that with regard to configurations of other points, these are the same as in the second embodiment so explanations thereon will be omitted.

Next, the action of the chair 10 according to the present embodiment will be explained.

In the present embodiment, the torque τ1, τ2 and τ3 that act upon each of the rotational axes of the first joint 16, second joint 17 and third joint 31 are represented by the following Formula 3, as in the second embodiment.

$$\begin{pmatrix} \tau 1 \\ \tau 2 \\ \tau 3 \end{pmatrix} = -\begin{pmatrix} \kappa 11 & \kappa 12 & \kappa 13 \\ \kappa 21 & \kappa 22 & \kappa 23 \\ \kappa 31 & \kappa 32 & \kappa 33 \end{pmatrix} \begin{pmatrix} \delta 1 \\ \delta 2 \\ \delta 3 \end{pmatrix} \quad \text{Formula 3}$$

Rotation of the first joint 16, second joint 17 and third joint 31 stop at the position where the torque T1, T2 and T3 that act upon each of the rotational axes of the first joint 16, second joint 17 and third joint 31 and the burden torque generated by the weight and posture of the seated user balance out, and the angles of the first link 11, second link 12 and third link 32 are determined. That is, the seating posture becomes fixed.

In this manner, in addition to the effect of the second embodiment, the chair 10 of the present embodiment has the effect of being able to adjust the positions of the seat surface portion 14 and back surface portion 15 in the up and down directions by appropriately adjusting each of the parameters.

Fourth Embodiment

Next, the fourth embodiment of the present invention will be explained. Note that with regard to components that have the same structure as in the first through third embodiments, explanations thereon will be omitted and the same symbol numbers will be applied. Further, explanations on actions and effects that are the same as in the first through third embodiments will also be omitted.

Figure 6:
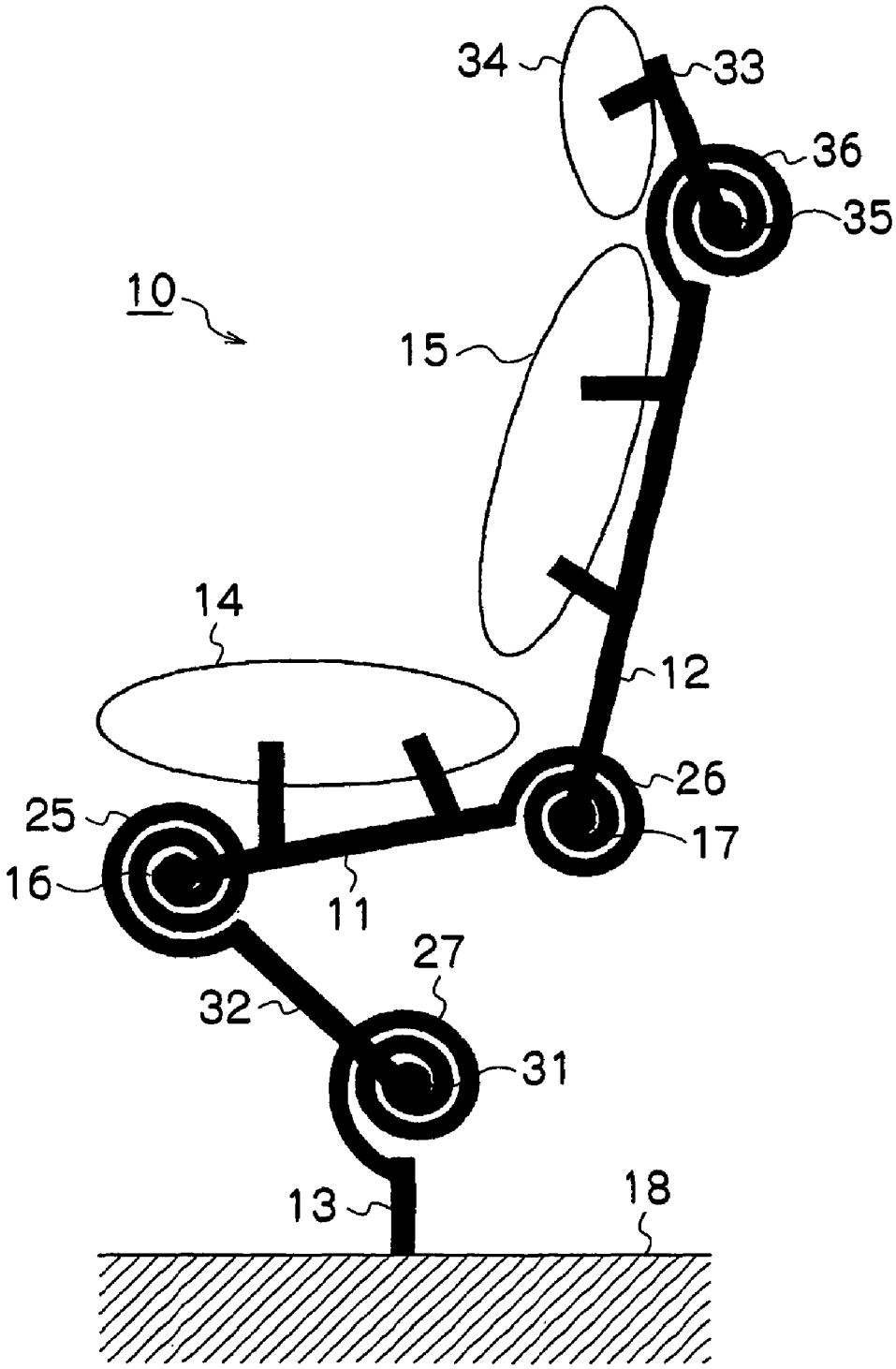
FIG. 6 is a drawing showing the configuration of the chair according to the fourth embodiment of the present invention.

FIG. 6 is a drawing showing the configuration of the chair according to the fourth embodiment of the present invention.

As shown in FIG. 6, the chair 10 according to the present embodiment includes a fourth link 33 connected to the upper end of the second link 12 and is provided with a cushion. The chair 10 also includes a pillow 34 fixed to the fourth link 33. In this case, the fourth link 33 is rotatably attached to the upper end of the second link 12 via a fourth joint 35. A fourth torsion spring 36 is arranged at the fourth joint 35 as a torque-generating mechanism. Note that the fourth joint 35 and the fourth torsion spring 36 are provided with the same configurations as the first joint 16, second joint 17 and third joint 31. as well as the first torsion spring 25, second torsion spring 26 and third torsion spring 27.

Further, an added torque-generating mechanism such as shown in FIGS. 3 and 4 is arranged between the second joint 17 and the fourth joint 35. Note that with regard to configurations of other points, these are the same as in the third embodiment so explanations thereon will be omitted.

Next, the action of the chair 10 according to the present embodiment will be explained.

In the present embodiment, the torque τ1, τ2, τ3 and τ4 that act upon each of the rotational axes of the first joint 16, second joint 17, third joint 31 and fourth joint 35 are represented by the following Formula 4, as in the second embodiment.

$$\begin{pmatrix} \tau 1 \\ \tau 2 \\ \tau 3 \\ \tau 4 \end{pmatrix} = -\begin{pmatrix} \kappa 11 & \kappa 12 & \kappa 13 & \kappa 14 \\ \kappa 21 & \kappa 22 & \kappa 23 & \kappa 24 \\ \kappa 31 & \kappa 32 & \kappa 33 & \kappa 34 \\ \kappa 41 & \kappa 42 & \kappa 43 & \kappa 44 \end{pmatrix} \begin{pmatrix} \delta 1 \\ \delta 2 \\ \delta 3 \\ \delta 4 \end{pmatrix} \quad \text{Formula 4}$$

Rotation of the first joint 16, second joint 17, third joint 31 and fourth joint 35 stop at the position where the torques τ1, τ2, τ3 and τ4 that act upon each of the rotational axes of the first joint 16, second joint 17, third joint 31 and fourth joint 35 and the burden torque generated by the weight and posture of the seated user balance out, and the angles of the first link 11, second link 12, third link 32 and fourth link 33 are determined. That is, the seating posture becomes fixed.

In this manner, in addition to the effect of the third embodiment, the chair 10 of the present embodiment has the effect of linking the pillow 34 as well as the seat surface portion 14 and back surface portion 15 and moving.

Alternative Examples

Next, an alternative example of the present invention will be explained.

Figure 7:
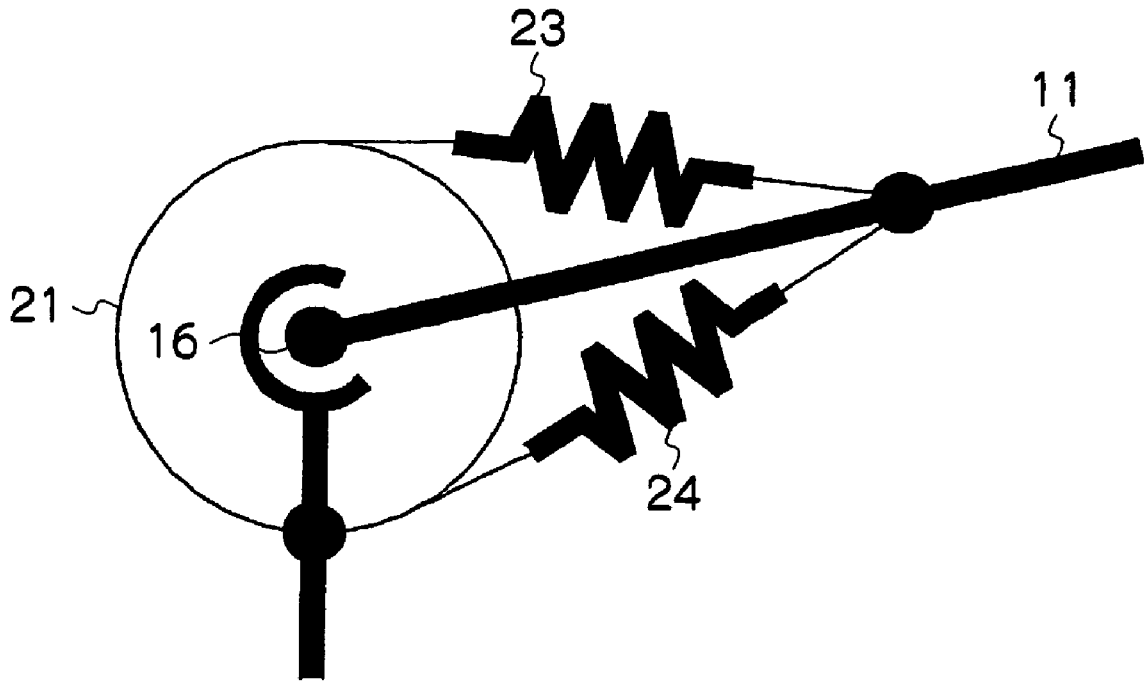
FIG. 7 is a drawing showing a torque-generating mechanism in an alternative example of the present invention.

FIG. 7 is a drawing showing a torque-generating mechanism in an alternative example of the present invention.

The structure that rotatably connects the base portion 13 and the first link 11 explained as in the first embodiment and the structure that rotatably connects the first link 11 and the second link 12 do not necessarily have to comprise a shaft and a shaft bearing in order to achieve the same effect, as long as these are structures where the elements can freely rotate.

Further, it is not absolutely necessary that the torque-generating mechanism, which generates torque of a strength in accordance with the rotational angles of the axes of rotation of the first joint 16 and second joint 17 as explained in the first embodiment, be a torsion spring. As is shown in FIG. 7, the same torque can be generated even if the mechanism is made from a pulley attached to the end of the link and a tension coil spring.

Furthermore, the added torque-generating mechanism that simultaneously generates torque in the first joint 16 and second joint 17 as explained in the second embodiment in accordance with the angles of rotation of the first joint 16 and second joint 17 does not necessarily have to be the mechanism as shown in FIGS. 3 and 4. As long as the mechanism generates the torques T1 and T2 shown in Formula 1, the same effect can be expected even if the mechanism is an electric motor.

Note that the present invention is not limited to the above-described embodiments. Various alternatives are possible based on the objective of the present invention, and these are not removed from the scope of the present invention.

What is claimed is:

1. A chair comprising:

(a) a base portion;

(b) a first link fixed to a seat and rotatably connected to the base portion;

(c) a second link fixed to a seat back rest and rotatably connected to the first link;

(d) a first torque-generating mechanism that generates torque in accordance with the angle of the first link relative to the base portion;

(e) a second torque-generating mechanism that generates torque in accordance with the angle of the second link relative to the first link; and (f) an added torque-generating mechanism including an elastic body connecting the base portion and the second link, and that simultaneously generates torque, which acts on a joint that connects the base portion and the first link, and torque, which acts on a joint that connects the first link and the second link in accordance with the angle of the first link relative to the base portion and the angle of the second link relative to the first link.

2. A chair comprising:

(a) a base portion;

(b) a first link fixed to a seat;

(c) a second link fixed to a seat back rest and rotatably connected to the first link;

(d) a third link whose one end is rotatably connected to the base portion and whose other end is rotatably connected to the first link;

(e) a first torque-generating mechanism that generates torque in accordance with the angle of the first link relative to the third link;

(f) a second torque-generating mechanism that generates torque in accordance with the angle of the second link relative to the first link;

(g) a third torque-generating mechanism that generates torque in accordance with the angle of the third link relative to the base portion;

(h) a first added torque-generating mechanism that simultaneously generates torque, which acts on a joint that connects the third link and the first link and torque, which acts on a joint that connects the first link and the second link in accordance with an angle of the first link relative to the third link and an angle of the second link relative to the first link; and (i) a second added torque-generating mechanism that simultaneously generates torque, which acts on a joint connected to the base portion and the third link, and torque, which acts upon a joint that connects the first link and the third link in accordance with an angle of the third link relative to the base portion and an angle of the third link relative to the first link.

3. A chair comprising:

(a) a base portion;

(b) a first link fixed to a seat;

(c) a second link fixed to a seat back rest and rotatably connected to the first link;

(d) a third link whose one end is rotatably connected to the base portion and whose other end is rotatably connected to the first link;

(e) a fourth link fixed to the back surface portion and rotatably connected to the second link;

(f) a first torque-generating mechanism that generates torque in accordance with the angle of the first link relative to the third link;

(g) a second torque-generating mechanism that generates torque in accordance with the angle of the second link relative to the first link;

(h) a third torque-generating mechanism that generates torque in accordance with the angle of the third link relative to the base portion;

(i) a fourth torque-generating mechanism that generates torque in accordance with the angle of the fourth link relative to the second link;

(j) a first added torque-generating mechanism that simultaneously generates torque, which acts on a joint that connects the third link and the first link, and torque, which acts on a joint that connects the first link and the second link in accordance with an angle of the first link relative to the third link and an angle of the second link relative to the first link;

(k) a second added torque-generating mechanism that simultaneously generates torque, which acts on a joint that connects the base portion and the third link, and torque, which acts on a joint that connects the first link and the third link in accordance with an angle of the third link relative to the base portion and an angle of the third link relative to the first link; and (l) a third added torque-generating mechanism that simultaneously generates torque, which acts on a joint that connects the second link and the fourth link, and torque, which acts on a joint that connects the first link and the second link in accordance with an angle of the fourth link relative to the second link and an angle of the second link relative to the first link.

* * * * *